US005926079A

United States Patent [19]

Heine et al.

[11] Patent Number: 5,926,079

[45] Date of Patent: Jul. 20, 1999

[54] CERAMIC WAVEGUIDE FILTER WITH EXTRACTED POLE

[75] Inventors: David R. Heine; Mark H. Ballance; Raymond Sokola, all of Albuquerque, N.M.; Protap Pramanick, Saskatoon, Canada

[73] Assignee: Motorola Inc., Schaumburg, Ill.

[21] Appl. No.: 08/761,105

[22] Filed: Dec. 5, 1996

[51] Int. Cl.[6] ..... H01P 1/207

[52] U.S. Cl. ..... 333/208; 333/212

[58] Field of Search ..... 333/202, 206, 333/208, 212, 219.1

[56] References Cited

U.S. PATENT DOCUMENTS

| | | | |
|---|---|---|---|
| 4,607,242 | 8/1986 | Cozzie | 333/208 X |
| 4,837,535 | 6/1989 | Konishi et al. | 333/212 X |
| 4,879,533 | 11/1989 | De Muro et al. | 333/206 |
| 4,963,844 | 10/1990 | Konishi et al. | 333/208 |

FOREIGN PATENT DOCUMENTS

| | | | |
|---|---|---|---|
| 0018260 | 2/1979 | Japan | 333/202 |
| 0220603 | 8/1988 | Japan | 333/208 |
| 6-177607 | 6/1994 | Japan | 333/206 |

*Primary Examiner*—Seungsook Ham

*Attorney, Agent, or Firm*—Gary J. Cunningham; Colin M. Raufer

[57] ABSTRACT

A ceramic waveguide filter made from a monolithic block of dielectric ceramic material which has longitudinally spaced resonators is described. Resonant structures having a grounded portion and ungrounded portion, each of the resonant structures being inductively coupled at the ungrounded portion describe the electrical schematic which corresponds to the waveguide filter. The positioning of the input and output on the block of dielectric ceramic material define a passband and also create a shunt resonant section. The shunt resonant section is associated with a shunt zero in the electrical schematic of the waveguide filter. Finally, the dielectric block of ceramic is mostly coated with an electrically conductive coating material with the exception of an uncoated area immediately surrounding the input and output. An extracted pole in the form of a shunt zero can provide a frequency response with a high side zero, low side zero, or both, and two extracted poles in the form of two shunt zeros can provide two high side zeros, two low side zeros, or one zero on each side of the passband. These features together provide a ceramic filter with a extracted pole.

12 Claims, 5 Drawing Sheets

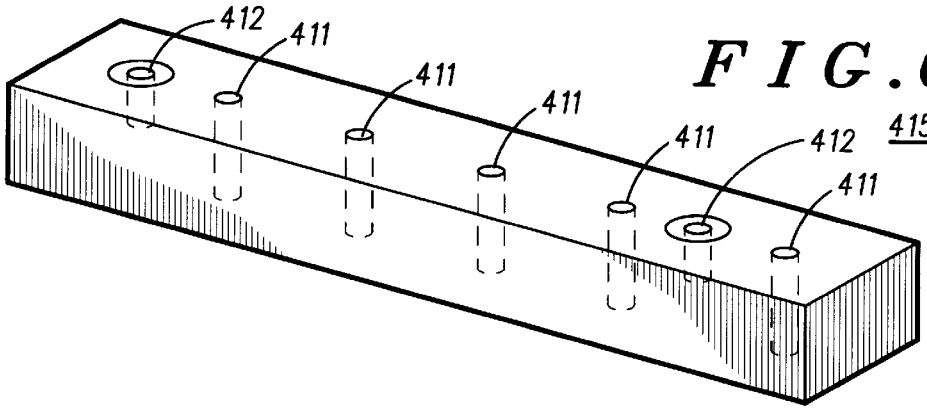
FIG. 6
FIG. 5
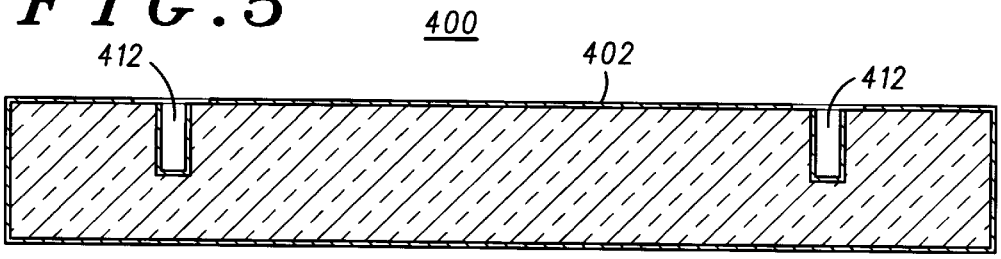
FIG. 7A
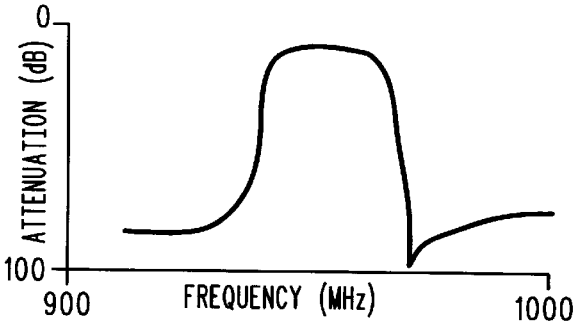
FIG. 7B
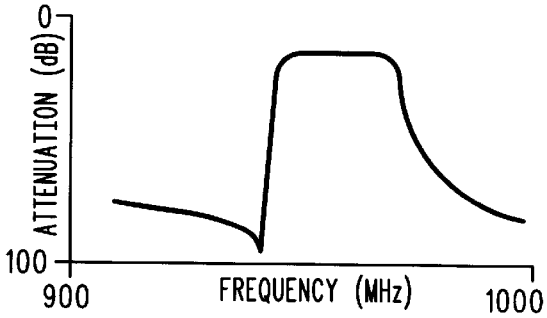
FIG. 8
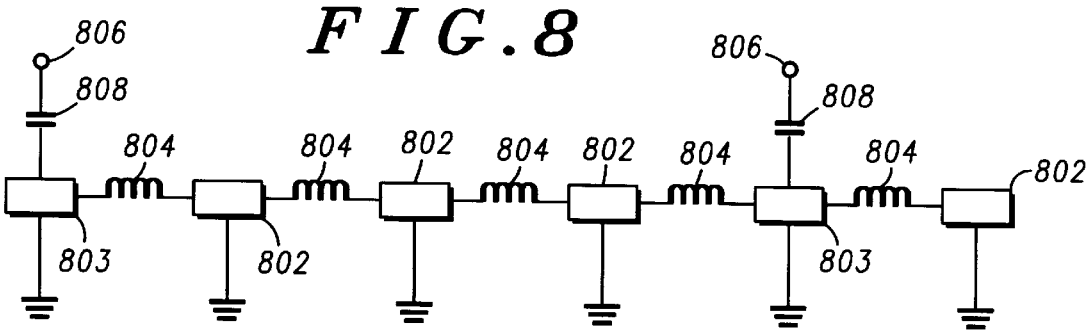

CERAMIC WAVEGUIDE FILTER WITH EXTRACTED POLE

FIELD OF THE INVENTION

This invention relates to ceramic filters used in electronic applications. More particularly, this invention relates to a ceramic waveguide filter with an extracted pole.

BACKGROUND OF THE INVENTION

Ceramic waveguide filters are well known in the art. In the electronics industry today, ceramic waveguide filters are typically designed using an "all pole" configuration in which all resonators are tuned to the passband frequencies. With this type of design, one way to increase the attenuation outside of the passband is to increase the number of resonators. The number of poles in a waveguide filter will determine important electrical characteristics such as passband insertion loss and stopband attenuation. The lengths and thickness of the resonant cavities, also known as resonant cells or resonant sections, will help to set the center frequency of the filter.

FIG. 1 shows a view of a prior art waveguide filter without extracted poles. In a conventional waveguide filter, resonators are spaced longitudinally and an electrical signal flows through successive resonators in series to form a passband. Waveguide filters are used for the same type of filtering applications as traditional dielectric blocks with through-hole resonators. One typical application for waveguide filters would be for use in base-station transceivers for cellular telephone networks.

In FIG. 1, the prior art waveguide filter 100 is made from a block of ceramic material, a top surface 102, a bottom surface 104, and side surfaces 106. The waveguide filter 100 also has longitudinally spaced cavities sections 108 which are separated and defined by notches 110. The waveguide filter 100 has an input and output 112 which consist of metallized blind holes on the top surface 102. All external surfaces of the waveguide filter 100, including the internal surfaces of the input and output 112, are coated with a conductive material. The waveguide filter 100 shows a dielectric block having five resonant sections, all longitudinally spaced in series.

Turning next to FIG. 2, a graph of the frequency response for the prior art ceramic waveguide filter of FIG. 1 is provided. This graph shows Attenuation (measured in dB) along the vertical axis and Frequency (measured in MHz) along the horizontal axis. On this graph, Attenuation values are between 0–100 dB and Frequency values are between 900–1000 MHz. These values are representative of just one application of the prior art waveguide filters. As this graph shows, when using a conventional waveguide filter design, there are no poles of attenuation located outside of the frequency passband of interest. This can restrict the design freedom of an engineer who builds systems using waveguide filters.

FIG. 3 shows an electrical schematic of the circuit for the prior art ceramic waveguide filter 100 of FIG. 1. Waveguide resonant structures 302 are connected to electrical ground and are separated by the inter-structure inductive couplings 304 which are created by the vertical slots 110 in FIG. 1. The electrical input and output 306 are coupled via capacitors 308 located at the end of the waveguide structures through the dielectric ceramic monoblock.

Unfortunately, the addition of resonators to increase the attenuation outside of the passband has the adverse effect of increasing the insertion loss as well as the overall dimensions of the filter. This is contrary to the trend in the industry which demands smaller components which are lighter and use less space inside of electronics equipment.

To address this problem, the present invention provides for a ceramic waveguide filter with extracted poles. With an extracted pole waveguide filter design, the number of in-band resonators can be reduced and one or more resonators can then be tuned outside the passband. The resonators which are tuned outside the passband can then be coupled to the electrical input and electrical output to provide increased attenuation at specific frequencies. As a result, with the present invention, it is possible to get enhanced attenuation of frequencies outside of the passband for a given size waveguide filter.

A ceramic waveguide filter with extracted poles which is achieved by strategic placement of the electrical input and output components and which provides more electrical attenuation at specific frequencies without increasing the overall size of the filter would be an improvement in the art.

BRIEF DESCRIPTION OF THE DRAWINGS

FIG. 5 shows a cross-sectional view, taken along axis 6—6, showing the metallized blind hole input-output receptacles of FIG. 4, in accordance with the present invention.

FIG. 6 shows a perspective view of another ceramic wavequide filter with an extracted pole having resonant sections or cavities defined by through-holes, in accordance with the present invention.

FIGS. 7A and 7B show graphs of possible frequency responses with a high side zero and a low side zero, repsectively, for the ceramic waveguide filter shown in FIG. 4, in accordance with the present invention.

FIG. 8 shows an equivalent circuit diagram of the ceramic waveguide filter in FIG. 4, in accordance with the present invention.

DETAILED DESCRIPTION OF THE PREFERRED EMBODIMENTS

The present invention is generally referred to as a ceramic waveguide filter having an extracted pole. An "extracted pole" is a term of art defined to be a resonant circuit element which is tuned outside the passband of the filter. The advantage of an extracted pole to a ceramic waveguide filter is in the fact that an extracted pole provides for greater out-of-band attenuation resulting in a higher level of performance for various signal processing applications. In the present invention, the "extracted pole" feature is achieved when either the input or the output, or both, are strategically positioned on the dielectric block. By physically relocating the input and the output more toward the center of the dielectric block (as compared with prior art ceramic waveguide filters), one or two shunt resonant sections can be created which result in a unique electrical frequency response and a unique circuit equivalent in a ceramic waveguide filter.

Figure 9:
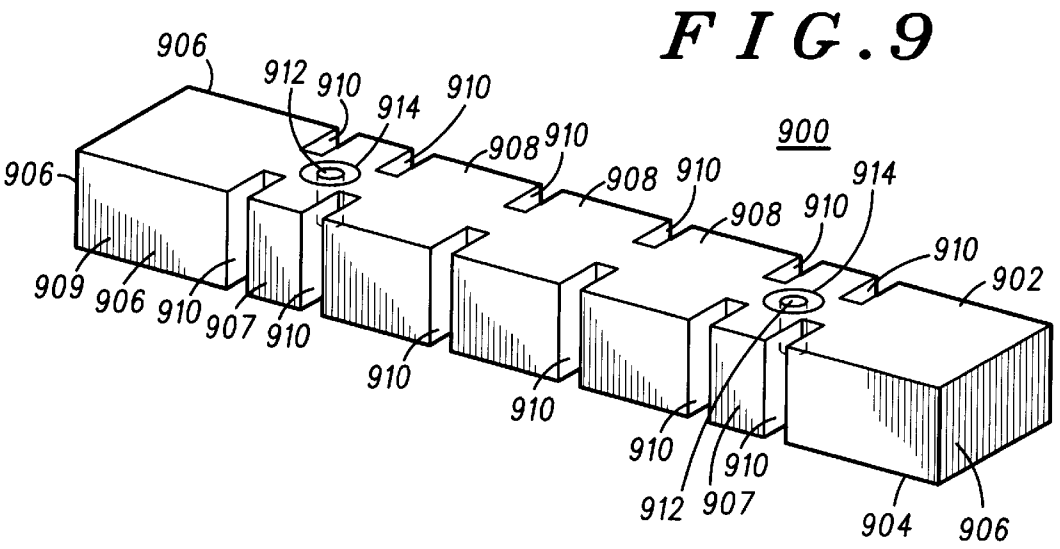
FIG. 9 shows a perspective view of an alternate embodiment of a ceramic waveguide filter with two extracted poles and two metallized blind hole receptacles, in accordance with the present invention.

The ceramic waveguide filter of the present invention is shown and described with reference to FIGS. 4–14. One important feature of the present invention is that by adding a shunt resonant section to the waveguide filter, the frequency response curve can be changed as desired. More specifically, the introduction of the shunt resonant section achieved by the strategic placement of the input and output components can create "notches", "zeros" or "nulls", also known as "poles of attenuation", which are located outside of the passband frequency of interest. This offers an advantage of increased attenuation outside the passband with little effect on the attenuation in the passband. This is shown clearly in the graphs provided in FIGS. 7 and 10. When one shunt resonant section is added to either end of the filter block, a zero is created at one end of the passband. When two shunt resonant sections are placed in the waveguide filter block, as shown in FIG. 9, two zeros can be created, providing even greater design flexibility and greater out-of-band attenuation.

Figure 1:
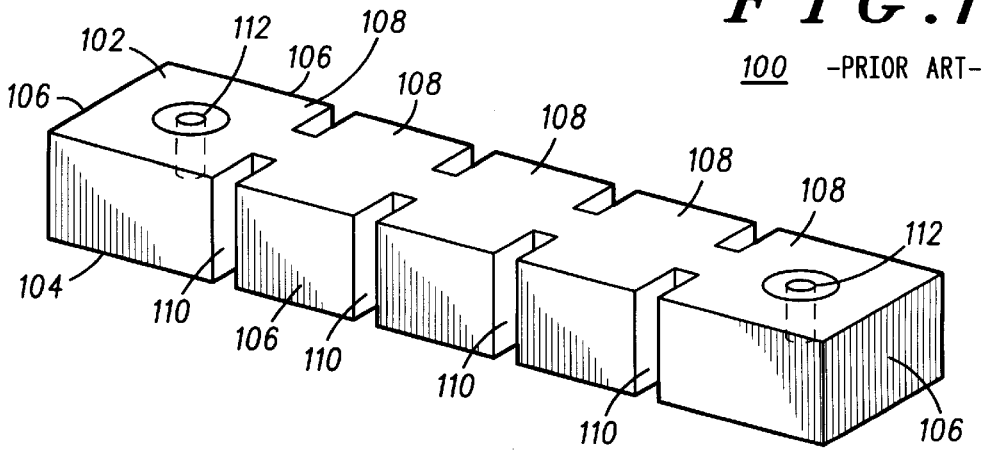
FIG. 1 shows a perspective view of a prior art ceramic waveguide filter.
Figure 2:
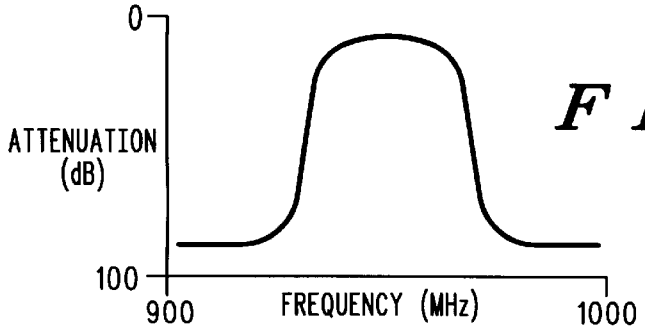
FIG. 2 shows a graph of the electrical frequency response curve for the prior art ceramic waveguide filter of FIG. 1.
Figure 3:
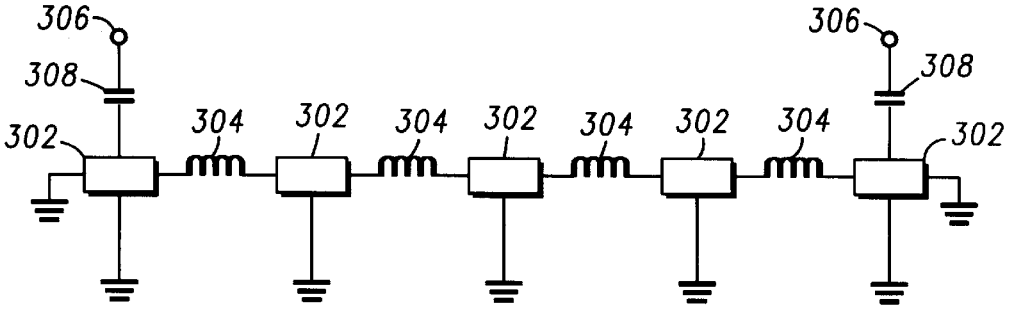
FIG. 3 shows an equivalent circuit diagram of the prior art ceramic waveguide filter of FIG. 1.
Figure 4:
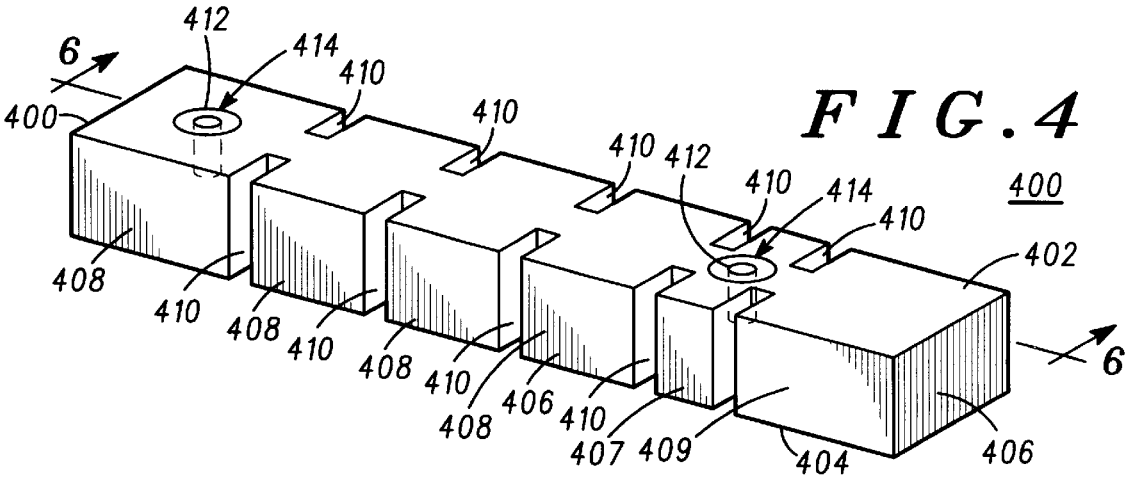
FIG. 4 shows a perspective view of a ceramic waveguide filter with an extracted pole, in accordance with the present invention.

Referring to FIG. 4, a perspective view of a ceramic filter 400 having an extracted pole is provided. More specifically, the waveguide filter 400 is made from a monoblock of dielectric ceramic material having a top surface 402, a bottom surface 404, and side surfaces 406. This waveguide filter also has a plurality of longitudinally spaced resonant sections (also referred to as cavities or cells) 408 which are separated and defined by notches 410 cut directly into the side surfaces of the waveguide filter, in this embodiment.

These notches 410 (also called vertical slots), are disposed longitudinally along the filter body to define the resonant cavities or cells through which the electrical signal propagates. The thickness and depth of these vertical slots control the electrical coupling and bandwidth and hence the characteristics of the filter.

The waveguide filter 400 has an electrical input and output 412 which include conductively coated or metallized blind holes which are placed into the top surface 402 of the waveguide filter. External surfaces of this waveguide filter, including the internal surfaces of the electrical input and output 412, are coated with a conductive material, with the exception of an uncoated region 414 immediately surrounding the input and output 412. In a preferred embodiment, waveguide filter 400 shows a structure having six resonant sections for a desired frequency response, and all are longitudinally spaced in series. However, more or less resonant sections may be used depending on the application.

Referring to FIG. 4, the waveguide filter 400 shows a shunt resonant section 409 located at one end of the waveguide filter 400. It is important to note that the shunt resonant section 409 is not located between the electrical input and the electrical output, rather it is in an isolated location at the end of the dielectric block. Additionally, shunt resonant section 409 is tuned outside the passband frequency. With this design, a ceramic waveguide filter having an extracted pole is provided. By strategically placing the shunt resonant section 409 outside the frequency passband of interest, additional "zeros" or poles of attenuation are created which offer greater design flexibility and latitude, and a desirable frequency response.

Shunt resonant section 409 will generally be located toward the end of the dielectric block 400. This shunt resonant section will be tuned outside of the passband, and therefore cannot be positioned between the input and output. In a preferred embodiment, the shunt resonant section 409 will be placed either in an end resonator of the waveguide filter or in the region between the end resonator and a successive resonator in the waveguide filter block.

Another feature of the monoblock, which can be seen with reference to FIG. 4, is the existence of a "coupling resonant section", shown as 407 in FIG. 4. The coupling resonant section 407 is a section or cell whose dimensions are slightly smaller than the other resonant sections 408, in one embodiment. A pair of coupling resonant sections 907 are also shown in FIG. 9, and will be discussed in detail later in this specification.

Coupling resonant sections 407 in FIG. 4, for example are resonant structures whose impedance characteristics at the operating frequency of interest (i.e. the center frequency of the filter) are such as to provide and permit proper impedance matching of the input and the output to their adjacent coupled resonators. In a preferred embodiment, the coupling resonant sections 407 have substantially smaller dimensions than the longitudinally spaced resonators 408 (resonant sections), and the coupling resonant sections 407 can be dispersed between the longitudinally spaced resonators (resonant sections) to provide desirable coupling characteristics for the waveguide filter 400.

FIG. 5 shows a cross-sectional view, along axis 6—6, (showing metallized blind hole input-output receptacles) of FIG. 4. In FIG. 5, the input and output 412 are conductively coated blind holes which are placed in the top surface 402 of the dielectric block 400.

FIG. 6 shows another embodiment of a ceramic waveguide filter 415 with an extracted pole. The ceramic waveguide filter 415 involves forming the longitudinally spaced resonant sections by strategically placing through-holes 411 longitudinally along the dielectric block. In one embodiment, the substantially vertical through-holes 411 are used in lieu of metallized vertical slots (410 in FIG. 4), and they define the resonators which form the waveguide filter. Thus, the ceramic waveguide filter 415 having through-holes which define the resonant sections is shown in FIG. 6. The filter of FIG. 6 is substantially similar to the filter of FIG. 4 in many respects, with the exception that the resonant sections are formed or defined in a different way. Although the substantially vertical through-holes (number 411 in FIG.

5) are preferably metallized, they serve a different purpose than the resonators in conventional combline dielectric filters.

FIGS. 7A and 7B show a pair of graphs with exemplary frequency responses for the ceramic waveguide filter 400 shown in FIG. 4. In FIGS. 7A and 7B, Attenuation is measured in dBs, along the vertical axis, and Frequency is measured in MHz, along the horizontal axis.

This waveguide filter design is adaptable for a variety of different Attenuation and Frequency ranges, the values on these graphs (FIGS. 7A and 7B) have been provided for exemplary purposes only. In FIG. 7A, the graph shows a "zero" on the high side of the passband, while FIG. 7B shows a "zero" on the low side of the passband. As these graphs show, using the waveguide filter design of the present invention, poles of attenuation (or "zeros") can be located outside of the passband of interest.

FIG. 8 shows an equivalent circuit diagram for the ceramic waveguide filter shown in FIG. 4. Waveguide resonant structures 802 are connected to electrical ground at one end and are coupled to adjacent resonant structures 802 by inter-structure inductive couplings 804, which are created by either the vertical slots (410 in FIG. 4) or through-holes (411 in FIG. 6). The input and output nodes 806 are shown capacitively coupled via capacitors 808 to end resonant structures 803 through the dielectric ceramic block itself. A waveguide shunt resonant section 805 is located outside of the frequency passband in FIG. 8, corresponding to the shunt resonant cavity 409 of FIG. 4.

In FIG. 8, the input and output are strategically positioned on the dielectric block such that the waveguide filter has a predefined input and output impedance. The need for specific input and output impedance characteristics is one of the few constraints in the placement of the input and output on the dielectric block 400. Although the input and output cannot be merely placed randomly on the dielectric block 400, by removing them from the outermost resonators, a desirable extracted pole design can be achieved while maintaining the desired input and output impedance characteristics.

By comparing FIG. 4 with FIG. 8 discussed previously, it is apparent that the number of longitudinally spaced resonators or cavities will be substantially equal to the number of poles in the waveguide filter. This is due to the fact that each of the resonant structures has a maximum input impedance at the resonant frequency. As such, the resonant structure acts as a pole.

The shunt resonant sections themselves can be either quarterwave or halfwave. When the dimensions of the shunt resonant sections are such that a halfwave section is created, a halfwave shunt resonant section is defined. When the dimensions of the shunt resonant section are such that a quarterwave section is created, a quarterwave shunt resonant section is defined. In a preferred embodiment, all resonant sections, including longitudinally spaced resonators 408, shunt resonant section 409, and coupling resonant section 407, will be halfwave. However, for certain applications where a waveguide filter with smaller dimensions are desired, a quarterwave shunt resonant section may be fabricated. A quarterwave shunt resonant section will result in a waveguide filter which is slightly shorter in length longitudinally, therefore resulting in a filter having smaller overall dimensions. These decreased filter dimensions, however, come at the expense of providing a filter which is more sensitive to the physical and electrical environment in the electronics system.

FIG. 9 shows another embodiment of a ceramic waveguide filter 900 with two extracted poles. In this embodiment, there are two shunt resonant sections 909, one at each end of the waveguide filter block 900, which create the two extracted poles. In FIG. 9, the waveguide filter 900 is made from a monoblock of dielectric ceramic material having a top surface 902, a bottom surface 904, and side surfaces 906. Filter 900 also has a plurality of longitudinally spaced resonant sections 908 which are separated and defined by notches 910 cut directly into the side surfaces 906 of the filter block 900. Shunt resonant sections or cells 909 are provided at each end of the dielectric block 900 which provide two shunt zeros in the passband. Coupling resonant sections 907, having slightly smaller dimensions compared to the longitudinally spaced resonant sections 908, are also provided. The waveguide filter has an electrical input and output 912 which include conductively coated blind holes which are placed into the top surface 902 of the waveguide filter. All external surfaces of this waveguide filter 900, including the internal surfaces of the electrical input and output 912, are coated with a conductive material, with the exception of an uncoated region 914 immediately surrounding the electrical input and output 912. In a preferred embodiment, waveguide filter 900 shows a structure having seven resonant sections. All are longitudinally spaced in series, however, more or less maybe used, depending on the application.

Referring to FIG. 9, the waveguide filter 900 show two shunt resonant sections 909, located at each end of the waveguide filter block 900. These two shunt resonant sections 909 are not located between the input and output 912, but rather between each input and output 912 and their respective ends of the filter block 900. Additionally, these two shunt resonant sections 909 are tuned outside of the passband frequency.

The input and output 912 are not placed near the shunt resonant sections 909 near the end of the block, but rather in one of the interior coupling resonant sections 907 distant from the ends of the dielectric block 900. This strategic placement of the input and output is desirable in order to leave one pole or resonant cavity which can be tuned outside of the passband of the filter. A waveguide filter design incorporating an additional pole, which can be tuned outside of the passband, offers many design options leading to a robust set of filter specifications. The addition of at least one shunt zero, in addition to the pre-existing filtering characteristics of waveguide filters, provides for a useful filter property which can be custom designed for specific signal processing applications.

Also in FIG. 9, the method or technique of electrically coupling into and out of the block 900 is variable and many options are available to the designer. One technique involves providing an input and an output by placing blind holes, which are plated with a conductive coating, into the block of dielectric material (see 912 in FIG. 9). The exact diameter and depth of the input and output can be varied to accommodate various design parameters. The shape and metallization of the shunt resonant sections are still another design variable. In a preferred embodiment, conductively coated blind holes 912 are placed in the top surface 902 of the waveguide filter dielectric block 900.

Figure 10A:
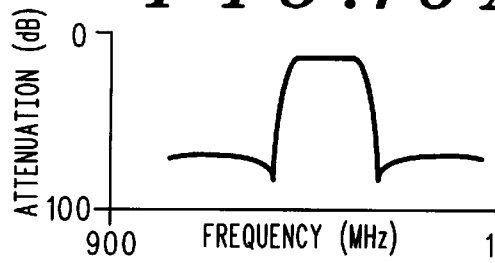
FIGS. 10A, 10B and 10C show three possible frequency responses for the ceramic waveguide filter of FIG. 9, with FIG. 10A having a high side zero and a low side zero, FIG. 10B having two low side zeros and FIG. 10C having two high side zeros, respectively, in accordance with the present invention.
Figure 10B:
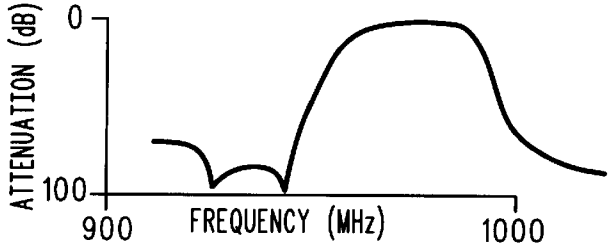
Figure 10C:
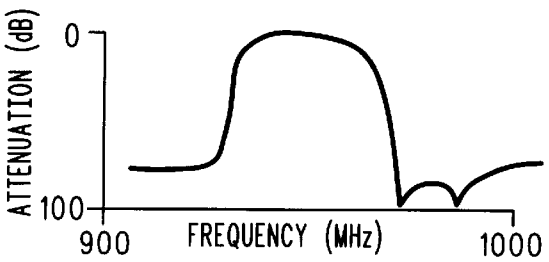

FIGS. 10A, 10B, and 10C show three graphs with exemplary frequency responses for the ceramic waveguide filter 900 with two extracted poles shown in FIG. 9. These frequency response curves have two extracted poles, and provide more out-of-band attenuation. This results in a higher level of performance in various signal processing systems. The various frequency response curves shown in FIGS. 10A, 10B, and 10C provide examples of the many design options available to the designer.

FIG. 10A shows a graph with one "zero" on each side of the frequency passband. FIG. 10B shows a graph with two "zeros" or "extracted poles" on the low side of the passband, while FIG. 10C shows a graph with two "zeros" or "extracted poles" on the high side of the frequency passband.

All three graphs of FIGS. 10A, 10B, 10C, show Attenuation (measured in dB) along the vertical axis and Frequency (measured in MHz) along the horizontal axis. The numerical representations on the graphs are for exemplary purposes only. Using the design of waveguide filter 900, poles of attenuation or "zeros" can be located outside of the frequency passband of interest. It can be noted that there is no correlation between the location of the "zero" in the passband and the location of the shunt resonant cavity on the end of the waveguide filter. For example, there may be two shunt resonant cavities, one located at each end of the waveguide filter block, yet this design may correspond to a frequency response curve having two high side "zeros" such as the frequency response curve shown in FIG. 10C.

The frequency of the "zeros" or "extracted poles", while always remaining outside of the frequency passband of interest, may be brought closer together or moved further apart depending upon the demands of a particular design. Additionally, by further manipulation of the design parameters such as the diameter, depth and exact location of the input and output, the input and output impedances may also be controlled. FIGS. 10A, 10B, and 10C are just examples of the many frequency response curve designs available to a designer, using a ceramic waveguide filter with an extracted pole.

Figure 11:
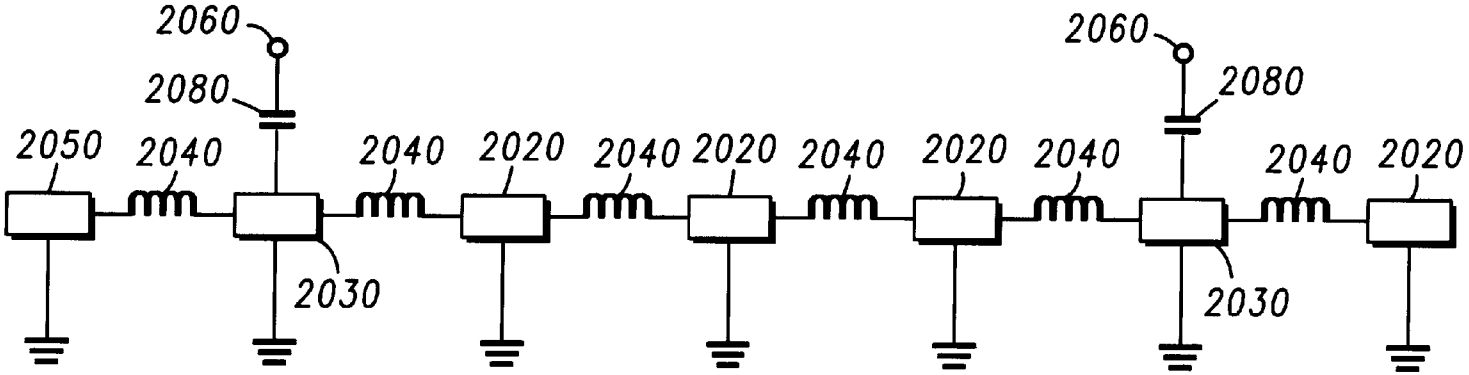
FIG. 11 shows an equivalent circuit diagram for the ceramic waveguide filter with two extracted poles as shown in FIG. 9, in accordance with the present invention FIG. 12. shows a perspective view of an alternate embodiment of a ceramic waveguide filter with two extracted poles and metallized through-hole input and output connections, in accordance with the present invention.

FIG. 11 shows an equivalent circuit diagram for a ceramic waveguide filter with two extracted poles as shown in FIG. 9. Waveguide resonant sections 2020 are connected to electrical ground at one end and are coupled to adjacent resonant structures by inter-structure inductive couplings 2040, which are created by the vertical slots (910 in FIG. 9). The input and output nodes 2060 are shown capacitively coupled via capacitors 2080 to resonant structures 2030 through the dielectric ceramic block itself. Two waveguide resonant structures 2050 are located outside of the frequency passband in FIG. 11, corresponding to the shunt resonant sections 909 of FIG. 9.

Figure 14:
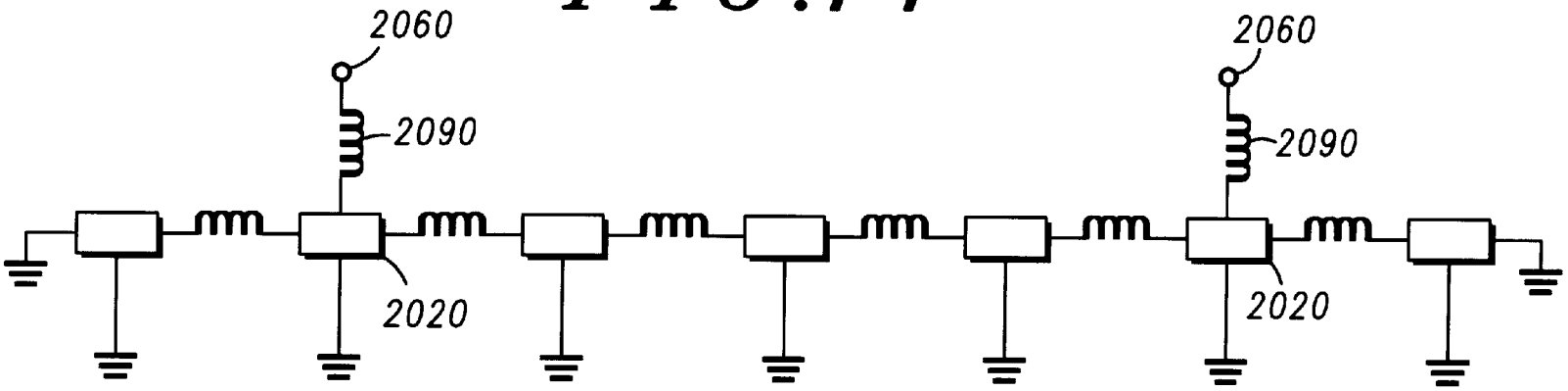
FIG. 14. shows an equivalent circuit diagram of the ceramic waveguide filter with two extracted poles and metallized through-hole input and output connections of FIG. 12, in accordance with the present invention.
Figure 12:
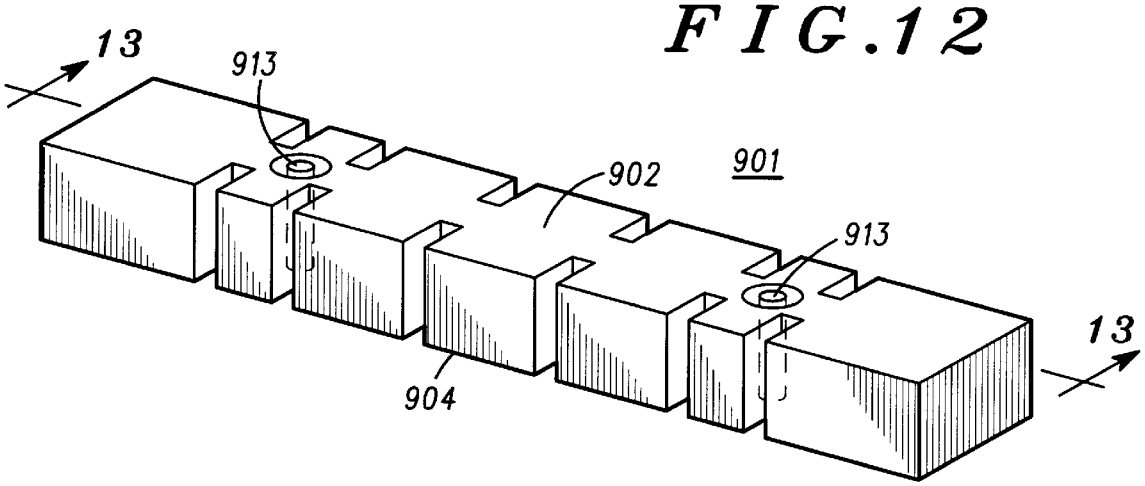
Figure 13:
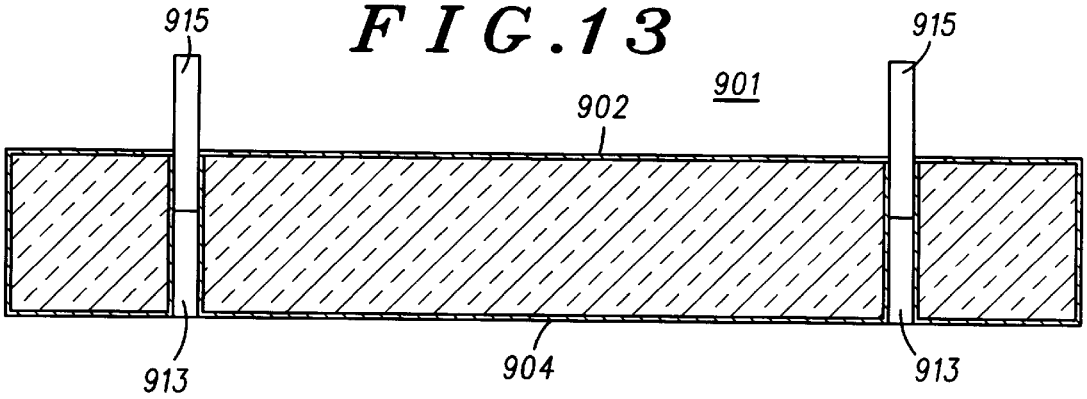
FIG. 13. shows a cross-sectional view, along axis 13—13 with through-hole input and output connections of the ceramic waveguide filter FIG. 12, in accordance with the present invention.

FIGS. 12–14 show another design possibility for the input and output connections which involve placing conductively coated through-holes 913 in the waveguide filter block 901. FIG. 12. shows an embodiment of a ceramic waveguide filter 901 with through-hole input and output connections 913. The waveguide filter 901 of FIG. 12 is substantially the same as the waveguide filter 900 of FIG. 9 with the exception that the through-hole input and output configurations 913 are different. As such, excluding through-hole input-output connections 913, all other numbers in FIG. 9 are incorporated by reference herein to FIG. 12. In FIG. 12, the input and the output 913 are conductively coated through-holes, which run through the dielectric block 901 from the top surface 902 to the bottom surface 904.

FIG. 13. shows a cross-sectional view, along axis 13—13, of the ceramic waveguide filter 901 in FIG. 12. Through-holes 913, which form the input and output, pass entirely through the dielectric block 901, from the top surface 902 to the bottom surface 904. Also shown in FIG. 13 are two mounting posts 915, which connect the waveguide filter 901 to other electronic components. Mounting posts 915, also known as conductive pins, can be used to mount the waveguide filter 901 onto a printed circuit board or other electronic apparatus. In FIG. 13, the input and the output 913 are through-hole receptacles, complementarily configured to receive a conductor (mounting post) and adapted to be connected to a circuit board. Of course, many different connection techniques could be used to connect the waveguide filter 901 to the other electronic components. Examples of electrical connection techniques include a wire, a conductive transmission line, or any other connection technique known in the art.

FIG. 14. shows an equivalent circuit diagram of the ceramic waveguide filter 901 of FIG. 12. When a through-hole input and output design is employed (see 913 in FIG. 13), the corresponding equivalent circuit will show inductive coupling 2090 between the input and output 2060 and the waveguide resonant structure 2020.

The equivalent circuit diagram of FIG. 14 is substantially the same as the equivalent circuit of FIG. 11 with the exception of the inductive coupling 2090. As such, only the components surrounding 2090 will be numbered and all other numbers on the equivalent circuit of FIG. 11 are incorporated by reference herein to FIG. 14. When the input and output connections (913 in FIG. 13) are conductively coated through-holes, the coupling will be inductive, whereas when the input and output connections are conductively coated blind holes (912 in FIG. 9), the coupling will be capacitive in nature.

All embodiments described above can be applied to a waveguide filter operating at any frequency in the electromagnetic spectrum. Certain possible applications include, but are not limited to, cellular telephones, cellular telephone base stations, and subscriber units. Other possible higher frequency applications include other telecommunication devices such as satellite communications, Global Positioning Satellites (GPS), or other microwave applications. Although the graphs in FIGS. 7 and 10 show exemplary applications in range of 900–1000 Mega-Hertz, the preferred embodiment of the present invention will involve applications in the range of 0.5 to 20 Giga-Hertz.

Although various embodiments of this invention have been shown and described, it should be understood that variations, modifications and substitutions, as well as rearrangements and combinations of the preceding embodiments can be made by those skilled in the art without departing from the novel spirit and scope of this invention.

What is claimed is:

1. A ceramic waveguide filter, comprising:

(a) a monolithic block of dielectric material having a plurality of longitudinally spaced resonant structures extending in a horizontal direction and providing a desired passband;

(b) an input and an output coupled to the plurality of longitudinally spaced resonant structures and at least one of the input and the output having a respective shunt resonant section immediately adjacent thereto and disposed in said block, said respective shunt resonant section having a resonant frequency which is outside the desired passband and providing a shunt zero;

(c) a first coupling resonant section disposed in said block having the input connected thereto and a second coupling resonant section disposed in said block having the output connected thereto, at least one of the first and second coupling resonant sections comprising a coupling interface, each of said coupling interfaces providing a first coupling means connected to the input or the output, a second coupling means connected to the plurality of longitudinally spaced resonant structures and a third coupling means connected to the shunt resonant section, and each of the first and second coupling resonant sections also being narrower in the horizontal direction than the plurality of longitudinally spaced resonant structures;

(d) the first and the second coupling resonant sections are respectively located between the plurality of longitudinally spaced resonant structures and the corresponding shunt resonant section and provide impedance matching and proper coupling of the plurality of longitudinally spaced resonant structures to the input and the output respectively; and (e) the block being substantially covered by a conductive coating with the exception of an uncoated area immediately surrounding the input and the output.

2. The waveguide filter of claim 1 wherein the shunt resonant section provides at least one shunt zero outside the passband.

3. The waveguide filter of claim 1 wherein the input and the output are positioned in proximity to the end portions of the block such that respective shunt resonant sections are provided at both end portions of the block thereby providing two shunt zeros outside the passband.

4. The waveguide filter of claim 1 wherein a dimension of the shunt resonant section defines a halfwave shunt resonant section.

5. The waveguide filter of claim 1 wherein a dimension of the shunt resonant section defines a quarterwave shunt resonant section.

6. The waveguide filter of claim 1 wherein the input and the output comprise receptacles complementary configured to receive a conductor and the receptacles are connected to a circuit board.

7. The waveguide filter of claim 1 wherein the passband has a predetermined bandwidth which is in the range of about 0.5 to about 20 Giga-Hertz.

8. The waveguide filter of claim 1 wherein the number of longitudinally spaced resonant structures is substantially equal to a number of poles in the waveguide filter.

9. A ceramic waveguide filter, comprising:

(a) a monolithic block of dielectric material having side surfaces and having substantially vertical slots symmetrically placed on the side surfaces defining longitudinally spaced resonant structures extending in a horizontal direction and providing a desired passband;

(b) an input and an output having conductively coated blind holes disposed in said block defining receptacles, the input and the output coupled to the plurality of longitudinally spaced resonant structures and at least one of the input and the output having a respective shunt resonant section immediately adjacent thereto and disposed in said block, said respective shunt resonant section having a resonant frequency which is outside the desired passband and providing a shunt zero;

(c) a first coupling resonant section disposed in said block having the input connected thereto and a second coupling resonant section disposed in said block having the output connected thereto; at least one of the first and second coupling resonant sections comprising a coupling interface, each of said coupling interfaces providing a first coupling means connected to the input or the output, a second coupling means connected to the plurality of longitudinally spaced resonant structures and a third coupling means connected to the shunt resonant section, and each of the first and second coupling resonant sections also being narrower in the horizontal direction than the plurality of longitudinally spaced resonant structures;

(d) the first and the second coupling resonant sections are respectively located between the plurality of longitudinally spaced resonant structures and the corresponding shunt resonant section and provide impedance matching and proper coupling of the plurality of longitudinally spaced resonant structures to the input and the output respectively; and (e) the block being substantially covered by a conductive coating with the exception of an uncoated area immediately surrounding the receptacles.

10. A ceramic waveguide filter, comprising:

(a) a monolithic block of dielectric material having a plurality of longitudinally spaced resonant structures extending in a horizontal direction and providing a desired passband;

(b) an input and an output coupled to the plurality of longitudinally spaced resonant structures and at least one of the input and the output having a respective shunt resonant section immediately adjacent thereto and disposed in said block, said respective shunt resonant section having a resonant frequency which is outside the desired passband and providing a shunt zero, and (c) a single coupling resonant section disposed in said block having the input or the output connected thereto; the single coupling resonant section comprising a coupling interface providing a first coupling means connected to the input or the output and a second coupling means connected to the plurality of longitudinally spaced resonant structures and a third coupling means connected to the shunt resonant section, and the single coupling resonant section also being narrower in the horizontal direction than the plurality of longitudinally spaced resonant structures;

(d) the single coupling resonant section is between the plurality of longitudinally spaced resonant structures and the shunt resonant section and provides impedance matching and proper coupling of the plurality of longitudinally spaced resonant structures to the input or the output; and (e) the block being substantially covered by a conductive coating with the exception of an uncoated area immediately surrounding the input and the output.

11. The waveguide filter of claim 9 wherein the number of longitudinally spaced resonant structures is substantially equal to a number of poles in the waveguide filter.

12. The waveguide filter of claim 9 wherein the passband has a predetermined bandwidth which is in the range of about 500 to about 1000 Mega-Hertz.

* * * * *